United States Patent [19]

Martelli

[11] 4,333,571

[45] Jun. 8, 1982

[54] PACKAGING UNIT FOR FRUIT OR LIKE ARTICLES

[75] Inventor: Nerio Martelli, Bologna, Italy

[73] Assignee: NESPAK S.p.A. Societa' Generale per l'Imballaggio, Massa Lombarda, Italy

[21] Appl. No.: 152,480

[22] Filed: May 22, 1980

[30] Foreign Application Priority Data

May 30, 1979 [IT] Italy ..... 12622 A/79

[51] Int. Cl.[3] ..... B65D 85/34; B65D 21/02; B65D 23/00

[52] U.S. Cl. ..... 206/499; 206/526; 217/26.5; 229/2.5 R

[58] Field of Search ..... 206/526, 563, 499, 315 B, 206/45.33; 224/919; 229/2.5 R, 2.5; 217/26.5

[56] References Cited

U.S. PATENT DOCUMENTS

| | | | |
|---|---|---|---|
| 3,221,971 | 12/1967 | Reny | 229/2.5 |
| 3,262,786 | 7/1966 | Weiss | 206/499 X |
| 3,281,003 | 10/1966 | Pesut, Jr. | 217/26.5 |
| 3,410,437 | 11/1968 | Martelli et al. | 217/26.5 |
| 3,695,479 | 10/1972 | Crabtree | 217/26.5 |
| 3,962,469 | 6/1976 | Leavens et al. | 206/499 X |
| 4,195,743 | 4/1980 | Emery | 217/26.5 |

*Primary Examiner*—Steven M. Pollard
*Attorney, Agent, or Firm*—Larson and Taylor

[57] ABSTRACT

A packaging unit for the packaging of fruit or like articles, comprises a rigid open-top box-like container made of plastics, and a plurality of substantially rectangular pocket trays disposed vertically in the said container, with one side resting on the bottom of said container. Each pocket tray is made of foamed plastic sheet and presents a plurality of staggered parallel rows of upwardly directed pockets, in which the top rim of each pocket has an approximately triangular shape in plan, with curvilinear convex sides, the vertexes of each triangular pocket being arranged at a higher level than the sides joining the said vertexes, whereby two adjacent pockets of one row and the intermediate pocket of the adjoining staggered row define, in correspondence of the common vertex, a triangular pyramidal projection. The side of the triangular pyramidal projection, which is part of the said intermediate pocket, is concave. In this manner, the fruit arranged in the said intermediate pocket rests, whenever the tray is disposed in vertical arranged relation with the fruits therein, on the said concave side of the pyramidal projection.

9 Claims, 7 Drawing Figures

PACKAGING UNIT FOR FRUIT OR LIKE ARTICLES

SUMMARY OF THE INVENTION

This invention relates to a packaging unit, particularly suitable for the packaging of fruits and vegetables, even delicate, such as peaches, plums or the like.

A packaging unit according to the invention comprises a rigid open-top box-like container made of plastics, and a plurality of substantially rectangular pocket trays disposed vertically in the said container, with one side resting on the bottom thereof. Each pocket tray is made of foamed plastic sheet and presents a plurality of staggered parallel rows of upwardly directed pockets, in which the top rim of each pocket has an approximately triangular shape in plan, with curvilinear convex sides, the vertexes of each triangular pocket being arranged at a higher level than the sides joining the said vertexes, whereby two adjacent pockets of one row and the intermediate pocket of the adjoining staggered row define, in correspondence of the common vertex, a triangular pyramidal projection. The side of the triangular pyramidal projection, which is part of the said intermediate pocket, is concave. In this manner, the fruit arranged in the said intermediate pocket rests, whenever the tray is disposed vertically arranged with the fruits therein, on the said concave side of the pyramidal projection. The fruits arranged in a tray are firmly secured therein by wrapping the filled tray with any suitable covering, such as for example a stretch-film wrapper of known type.

DESCRIPTION OF THE PREFERRED EMBODIMENT

Figure 1:
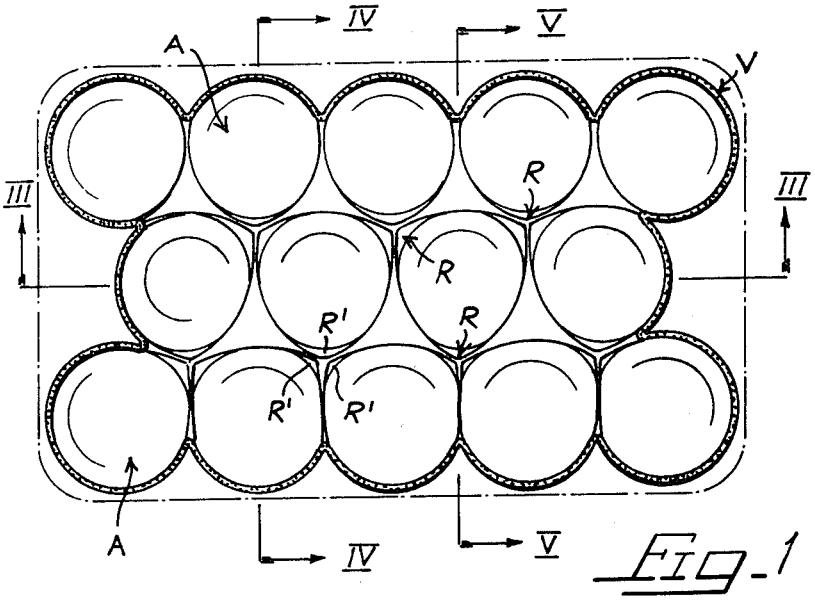
FIGS. 1 and 2 are diagrammatic top plan views of two different types of pocket trays that can be used for forming the packaging unit according to the invention.

According to the invention, there is provided a pocket tray V of the type shown in FIG. 1, which is preferably made of foamed plastics, particularly of foamed polystyrene of suitable thickness, or of any other suitable material affording a sufficiently sturdy structure and yet a sufficient yieldability across its thickness.

The length and width dimensions of the tray are such that it can be contained with enough clearance in the width and depth dimensions of parallelepipedal crates made of a plastics material of the type hereinafter described.

Depending upon the size of the fruits to be packed, the pockets A of a tray are in the number shown in FIG. 1 or any other suitable number; therefore, said pockets can be disposed either on three rows or any other suitable number of rows.

FIG. 1 shows that said pockets are suitably staggered the one with respect to the other so that a tray can have the maximum capacity within the dimensions specified above.

As for the shape of said pockets it is to be noted that the same must be such as to snugly contain and support each fruit. To this purpose, said tray can be made according to the teachings of the U.S. Pat. No. 3,410,437 (MARTELLI et al.) in which said pockets embrace the fruits due to their section progressively decreasing towards the bottom, and each have a substantially-triangular mouth, with triangles having curved convex sides and, therefore, "radially" deformable, and with the apexes thereof (at least of the inner pockets) lying at the apexes of respective pyramidal projections R.

Figure 4:
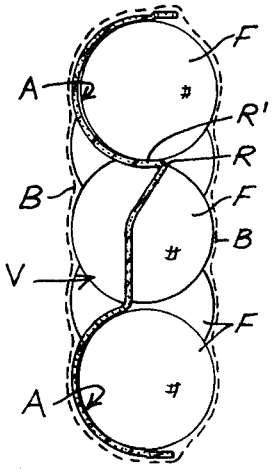
Figure 5:
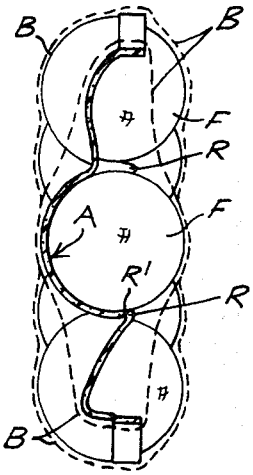

On FIGS. 4 and 5 it can be seen that the side faces of said pyramidal projections R have such a height as to co-operate with a fruit above its equatorial region and have a suitable concave shape as shown at R', so that when a tray is disposed sidewise or vertically as shown in these FIGS. 4 and 5 said projections operate as shelves that co-operate to hold each fruit in a respective pocket A.

On FIGS. 1, 3, 4 and 5 it can also be seen that a tray V can have a peripheral sinuous configuration that closely circumscribes the pockets A, so that the tray will not have those peripheral exceeding portions of material that give the conventional pocket trays their rectangular or polygonal configuration. The reason for said peripheral configuration of the tray V is that said tray, after being filled with the fruits F (see FIGS. 3, 4 and 5), is wrapped in a well tightened covering B, for example of a stretchable or heat shrinkable film, that will lock said fruits in their respective pockets and will give the package a sufficient structural rigidity. As the peripheral configuration of the tray is such as to closely adhere to the fruits, the wrapping film B will maintain its initial condition of tightness and contact against the fruits, in that no yielding of unsupported peripheral portions of the tray can occur. Anyway, the pocket trays V can have any peripheral configuration, such as with a peripheral straight rim, at least on one side or preferably on at least two opposed sides, or even a rectangular or polygonal configuration, as shown by dash-and-dot lines in FIGS. 1 and 2.

After being wrapped in said covering film B, the package can be easily and safely handled with obvious advantages.

In order to permit the fruits within the pocket tray to be areated as necessary, the wrapping film B can leave the end portions of a tray uncovered. Otherwise, the film B can wrap a package completely, but in this case the film should be of stretchable type and perforated, or it should be of any other suitable type and of such chemical-physical characteristics as to constitute a physiological package assuring an optimum storage of the fruits F.

It is to be understood that both the tray and the wrapping film can be of any suitable color, can be printed as desired and can be personalized in any desired manner.

Figure 7:
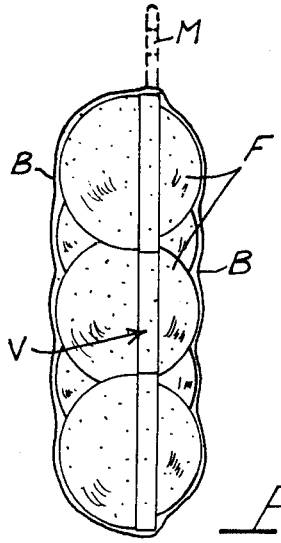
FIG. 7 is a diagrammatic side view of a filled and wrapped tray provided with an optional handle to facilitate the handling thereof.

As diagrammatically shown in FIG. 7, each tray can be provided with a handle M to facilitate handling and transportation thereof. The handle can be fixed by either metallic or adhesive fastenings, or by a fastening belt placed around the package, or by any other known means.

Said handle can be also fitted at the moment of sale to a purchaser. For this purpose, a number of separate handles can be placed in the crate containing the wrapped trays.

Figure 6:
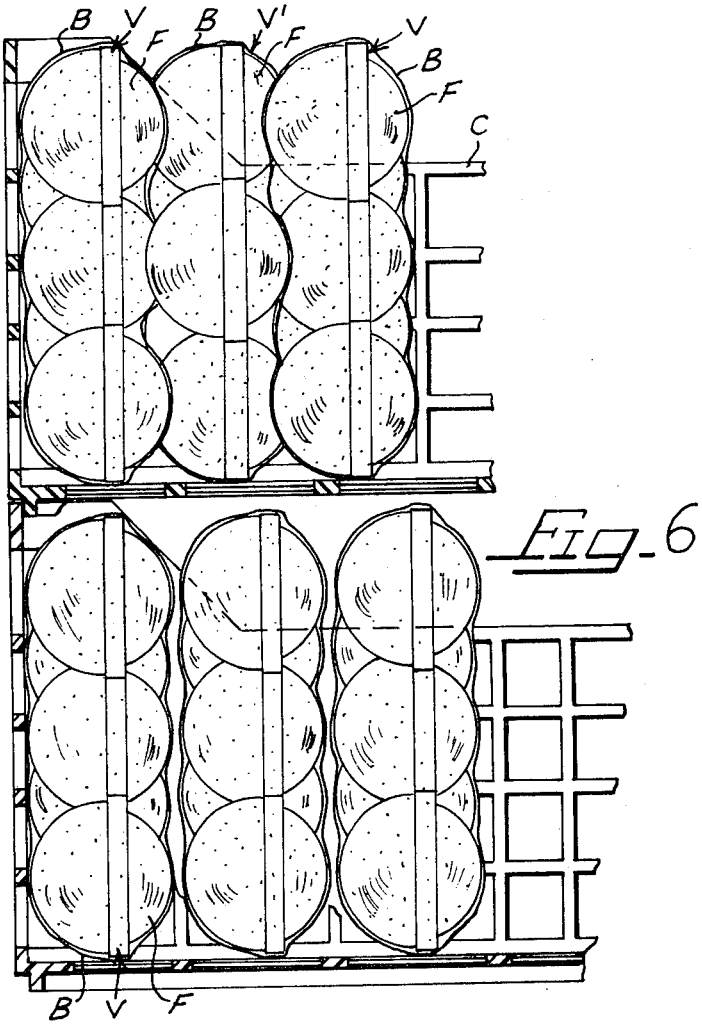
FIG. 6 is a side view with parts in section, of two superposed packaging units packed for storing and transporting purposes.

The filled and wrapped trays thus formed are then placed sidewise or endwise in side-by-side relationship within parallelepipedal crates C, such as that shown in FIG. 6, of lattice construction, preferably of stackable type and made of plastics.

Figure 2:
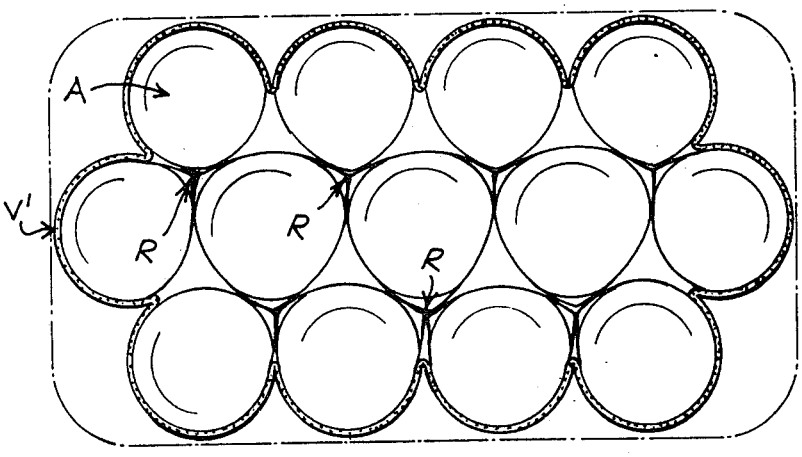
Figure 3:
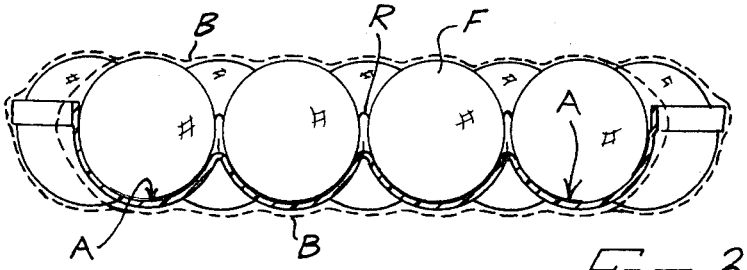
FIGS. 3, 4 and 5 are detail sectional views of the tray of FIG. 1, filled with fruits and wrapped, respectively on the lines III—III, IV—IV and V—V of FIG. 1.

To achieve a better exploitation of the capacity of crates C, as an alternative to the use of packaging trays V of the type shown in FIG. 1, packaging trays V' of the type shown in FIG. 2 can also be used. By suitably alternating trays V and trays V', as shown in the upper portion of FIG. 6, the projecting portions of a tray engage with the recessed portions of the adjoining trays, so as to achieve said better exploitation of the capacity.

The advantages resulting from said packaging system can be thus summarized:

The packaged products can reach the retail market in a prefectly sound condition as they are supported one by one delicately and extensively by the pockets and the adjacent wrapping film that holds the fruits in said pockets, and inasmuch as due to said sidewise positioning the several trays in a crate cannot weigh on each other.

The packaging is economically convenient due to the following reasons:

In said plastic crates two or more superimposed layers of fruits can be stored, and yet the underlying layer or layers will not support the burden of the superimposed layer. The cost of a crate will be divided on a greater number of layers of fruits in comparison with the conventional crates containing generally one single layer, particularly in case of very delicate fruits. No protective material is to be interposed to avoid that the trays damage each other.

By virtue of said vertical arrangement of the trays, the depth of the crates C can be thoroughly and completely exploited, inasmuch as possible differences of size of the fruits will cause variations of size of a package either transversally or longitudinally, but never in the direction of the height. Moreover, it is to be noted that a crate of the above type, being made of plastics, has a much lower cost than conventional wooden crates.

It is to be understood that the preferred embodiment of the invention above shown and described can undergo several changes and modifications, without departing from the basic principle of the invention as above described, as shown in the accompanying drawings and as claimed in the appended claims.

I claim:

1. A packaging unit for the packaging of fruit or like articles comprising, in combination:

a rigid, box-like container having an accessible top, a bottom and four sides; and a plurality of substantially rectangular pocket trays mountable in said container with one end of said trays resting on said container bottom and the other end of said trays located at said container top such that said trays are substantially vertical when said container is resting horizontally on its bottom, and in a tray that presents, when disposed horizontally, a plurality of staggered parallel rows of upwardly directed pockets having a vertical cross-section generally conforming to the shape of the fruit or like articles to be placed therein, and in which the top rim of each pocket has an approximately triangular shape in plan and has curvilinear convex sides, and in which the vertices of each pocket are arranged at a higher level than the sides joining said vertices, whereby two adjacent pockets of one row and the intermediate pocket of the adjoining staggered row define a triangular pyramidal projection in correspondence of the common vertex, wherein the improvements in said pocket trays that permit their vertical packing in said container without damage to the contents of said pockets include said tray being made of foamed plastic sheet having a thickness in the pocket areas so as to afford a sufficiently sturdy structure that the pocket sides can operate as shelves to hold the pocket contents in the pocket, and at least the side of said pyramidal projection forming a part of said intermediate pocket being concave so that the pocket contents rest on said concave side of said pyramidal projection whenever said tray is disposed in a substantially vertical orientation.

2. In a packaging unit according to claim 1, a pocket tray in which the height of the said triangular pyramidal projection, with respect to the bottom of the pocket, substantially reaches the equatorial or middle height region of the fruit supported therein.

3. In a packaging unit according to claim 1, a pocket tray in which the height of the said pyramidal projection, with respect to the bottom of the pocket, is greater than the height of the equatorial or middle height region of the fruit supported therein.

4. A packaging unit according to claim 1, in which a series of pocket trays presents alternately, starting from one side of the tray, a row of N pockets and an adjoining parallel staggered row of N+1 pockets, while another series of pocket trays presents alternately starting from one side of the tray a row of N+1 pockets and an adjoining parallel staggered row of N pockets, and the above mentioned trays are stacked into the box-like container by alternating a tray of one series with a tray of another.

5. A packaging unit according to claim 1, further comprising a covering which is adapted to wrap the tray filled with fruits.

6. A packaging unit according to claim 5, in which the covering is made of suitable stretch film.

7. A packaging unit according to claim 1 in which said container is made of plastic and has an open top.

8. A packaging unit according to claim 1 in which said pocket trays have a peripheral sinuous configuration that closely circumscribes said pockets; and said packaging unit further comprising a flexible wrapping film adapted to wrap said tray after the pockets thereof have been filled with their respective contents such that the contents are locked in their respective pockets and said tray is given a greater structural rigidity.

9. A packaging unit according to claim 8 and further comprising a handle and means for removably attaching said handle to one of said pocket trays.

* * * * *